US006036106A

United States Patent [19]

Peet

[11] Patent Number: 6,036,106

[45] Date of Patent: Mar. 14, 2000

[54] DISPENSER HAVING LIQUID DISCHARGE ASSEMBLY WITH HIGH WEAR AND THERMAL CONDUCTIVITY PROPERTIES

[75] Inventor: Stephen L. Peet, Norcross, Ga.

[73] Assignee: Nordson Corporation, Westlake, Ohio

[21] Appl. No.: 09/245,143

[22] Filed: Feb. 4, 1999

[51] Int. Cl.[7] ..... B05B 1/24

[52] U.S. Cl. ..... 239/135; 239/128; 239/132; 239/133

[58] Field of Search ..... 239/128, 132, 239/133, 134, 135, 397.5

[56] References Cited

U.S. PATENT DOCUMENTS

| | | | |
|---|---|---|---|
| 4,301,966 | 11/1981 | Schwarz | 239/135 X |
| 4,635,851 | 1/1987 | Zeeman | 239/135 X |
| 5,027,976 | 7/1991 | Scholl et al. | 222/1 |
| 5,065,943 | 11/1991 | Boger et al. | 239/298 |
| 5,226,596 | 7/1993 | Okamura | 239/135 X |
| 5,407,101 | 4/1995 | Hubbard | 222/146.5 |
| 5,540,801 | 7/1996 | Grant et al. | 156/357 |
| 5,733,379 | 3/1998 | Schmitkons et al. | 124/19 |
| 5,747,102 | 5/1998 | Smith et al. | 427/96 |

FOREIGN PATENT DOCUMENTS

| | | | |
|---|---|---|---|
| 2620953 | 3/1989 | France | 239/135 |

*Primary Examiner*—Andres Kashnikow
*Assistant Examiner*—Robin O. Evans
*Attorney, Agent, or Firm*—Wood, Herron & Evans, L.L.P.

[57] ABSTRACT

A dispenser having a liquid discharge assembly adapted to conduct heat from a dispenser body into a heated liquid to prevent cooling of the liquid. The liquid discharge assembly includes an inner portion having a liquid passageway adapted to be in fluid communication with the dispenser body, an outer portion, and a thermally conducting layer positioned between the inner portion and the outer portion. The thermally conducting layer thermally contacts the heated dispenser body and has a thermal conductivity higher than the thermal conductivities of the adjacent inner and outer portions. Preferably, the thermally conducting layer is formed of copper and the inner and outer portions are formed of stainless steel.

21 Claims, 3 Drawing Sheets

DISPENSER HAVING LIQUID DISCHARGE ASSEMBLY WITH HIGH WEAR AND THERMAL CONDUCTIVITY PROPERTIES

FIELD OF THE INVENTION

The present invention generally relates to apparatus for dispensing heated liquids and, more specifically, to thermally conductive liquid discharge assemblies which assist in transferring heat into the liquids until immediately prior to discharge.

BACKGROUND OF THE INVENTION

Various types of dispensers exist for dispensing heated liquids at specified application temperatures. In many instances the dispenser must discharge the liquid within a precise, elevated temperature range. One such application is the dispensing of hot melt adhesives. Many hot melt adhesive dispensers take the form of a gun or module having a nozzle and an internal valve for regulating liquid flow through the nozzle. Often, the nozzle includes a valve seat engageable by a valve stem for flow control purposes. The dispenser module is typically heated to a desired liquid application temperature such as by being directly connected to a heated manifold. The temperature of the nozzle should be maintained at the required liquid application temperature so that the liquid will perform satisfactorily. If the nozzle is too cool, the liquid may cool down too much just prior to discharge, thereby adversely affecting the liquid cut-off at the nozzle when the valve stem is closed. More specifically, liquid hot melt adhesive may not shear properly when the valve is closed and instead may string and produce so-called angel hair. This angel hair can become airborne and contact other equipment or machinery, or adversely affect the substrate in other areas. Furthermore, if hot melt adhesive exits the nozzle at a reduced temperature, the reduced temperature can compromise the adhesive bond.

A prior two-piece nozzle incorporates an outer nozzle portion formed of a heat conductive metal, such as brass. As brass and other heat conductive metals are relatively soft, however, a carbide steel or other wear-resistant, press-fit insert is typically used as the valve seat portion of the nozzle. This two-piece nozzle sufficiently transfers heat from the dispenser body to the outer nozzle portion; however, it is a relatively costly construction.

A less costly one-piece nozzle with an integral valve seat unit has been manufactured entirely from stainless steel. However, because stainless steel has relatively low thermal conductivity properties, heat does not readily transfer from the dispenser body to the nozzle. Therefore, in some situations, this nozzle may be unable to maintain the requisite liquid temperature at the nozzle outlet.

To solve problems such as those mentioned above, it would be desirable to provide a relatively low cost nozzle having high wear resistance and high thermal conductivity properties.

SUMMARY OF INVENTION

The present invention therefore provides a dispenser and, more specifically, a liquid discharge assembly that overcomes various problems relating to the optimization of cost, heat conduction and wear considerations. The liquid discharge assembly has enhanced thermal conductivity properties such that the temperature of the heated liquid exiting the assembly is substantially equal to the temperature of the heated liquid entering the assembly. The liquid discharge assembly includes a thermally conductive, intermediate layer that conducts heat throughout at least an end portion of the assembly so that the heated liquid does not cool substantially below the required application temperature. Additionally, the liquid discharge assembly is relatively inexpensive to manufacture and includes an inner portion and an outer portion constructed from wear resistant material.

The intermediate thermally conducting layer is adapted to contact the heated dispenser and has a thermal conductivity higher than the thermal conductivity of the adjacent inner and outer portions. The liquid discharge assembly has a surface mating to the dispenser body and a discharge end for discharging the heated liquid. The thermally conducting layer preferably extends from the mating surface to the discharge end of the liquid discharge assembly and therefore promotes heat conduction from the dispenser body to the discharge end.

Although the thermally conducting layer can be any suitable material with relatively high thermal conductivity, the layer is preferably formed of copper. Similarly, the inner portion and the outer portion can be any suitable material with higher wear resistance properties than the intermediate layer. Preferably, the inner portion and the outer portion are both formed of stainless steel. The outer portion is a mounting member for mounting the liquid discharge assembly to the dispenser body and further includes threads for engaging a nozzle. The liquid discharge assembly may be manufactured using relatively low cost methods. In particular, the inner and outer portions may be formed by metal injection molding (MIM) techniques and may each be press fit to the intermediate layer. The intermediate layer may be formed in any suitable manner, such as by using a deep drawing process.

Various additional features, advantages and objects of the invention will become more readily apparent to those of ordinary skill in the art upon consideration of the following detailed description of the preferred embodiment taken in conjunction with the accompanying drawings.

DETAILED DESCRIPTION OF DRAWINGS

DETAILED DESCRIPTION OF PREFERRED EMBODIMENTS

Figure 1:
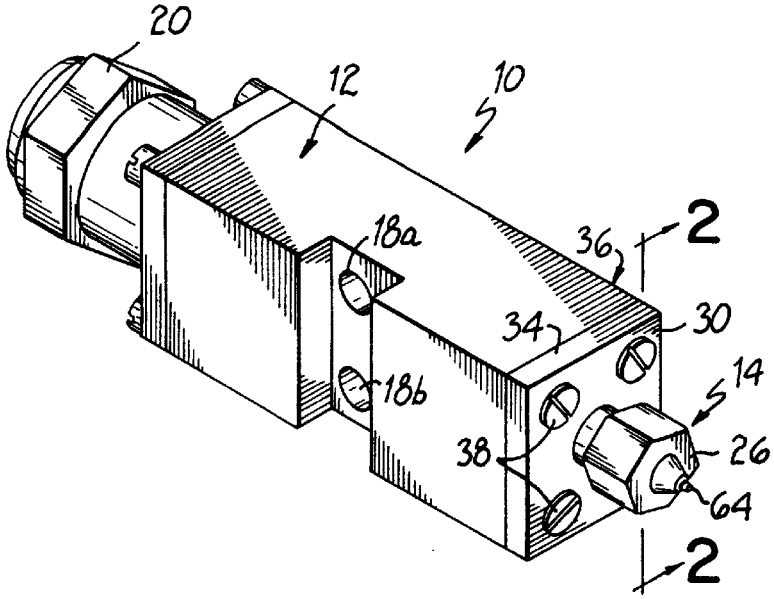
FIG. 1 is a perspective view of a dispenser incorporating a liquid discharge assembly constructed according to the preferred embodiment of the invention.
Figure 2:
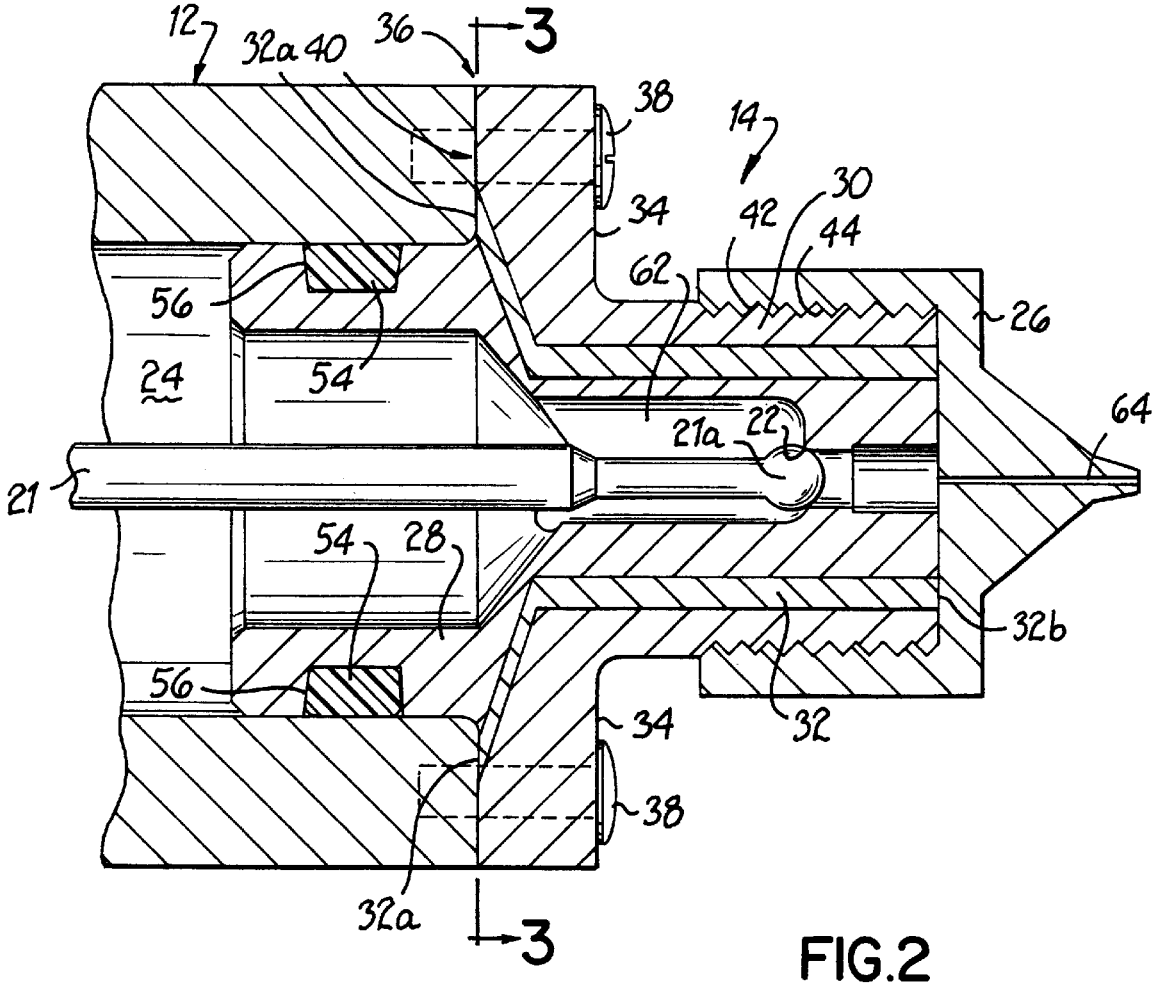
FIG. 2 is an enlarged cross-sectional view of the liquid discharge assembly taken along line 2—2 of FIG. 1.

Referring first to FIGS. 1 and 2, a dispenser 10 is shown having a dispenser body 12 and a liquid discharge assembly 14 constructed in accordance with the principles of this invention. The dispenser 10 is specifically adapted for dispensing a heated liquid, such as heated thermoplastic liquids or hot melt adhesives, but other heated liquid dispensers will benefit from the invention as well. The inventive principles will be described with reference to only one of many possible embodiments and uses of dispensers and liquid discharge assemblies falling within the scope of this invention.

Generally, hot melt adhesives flow through heated passageways in order to reach and/or maintain a desired application temperature. If, for example, the hot melt adhesive flows through a passageway or nozzle heated to a temperature below the required application temperature, the temperature of the adhesive will decrease to the temperature of the surrounding passageway. Accordingly, to maintain the liquid at the desired application temperature, an external heat source, such as a heated manifold or service block, not shown, typically connects to and heats the dispenser body 12 and the liquid discharge assembly 14 through conduction.

The dispenser body 12 includes mounting holes 18*a*, 18*b* for mounting the dispenser body 12 to a support structure, such as the heated manifold or service block mentioned above. One side of the dispenser body 12 will typically include inlet ports, not shown, for abutting the manifold and introducing pressurized air and heated liquid into appropriate passageways. The illustrated dispenser body 12 includes a spring return mechanism (not shown) mounted within a portion 20 of body 12 and operatively connected to a valve stem 21 having a valve stem tip 21*a*. The spring return mechanism closes the valve stem 21 against a valve seat 22 for stopping the flow of liquid from the dispenser 10. The valve stem 21 may be pneumatically or electrically actuated to selectively dispense liquid in generally known manners. Dispenser body 12 is only one of many possible dispenser bodies usable with the liquid discharge assembly 14 of this invention. Other types of pneumatically or electrically operated dispensers or manually operated dispensers may also benefit from using liquid discharge assembly 14. Commercially available dispensing guns usable with liquid discharge assembly 14 include the H-200 and H-400 modules, available from Nordson Corporation, Westlake, Ohio.

Figure 3:
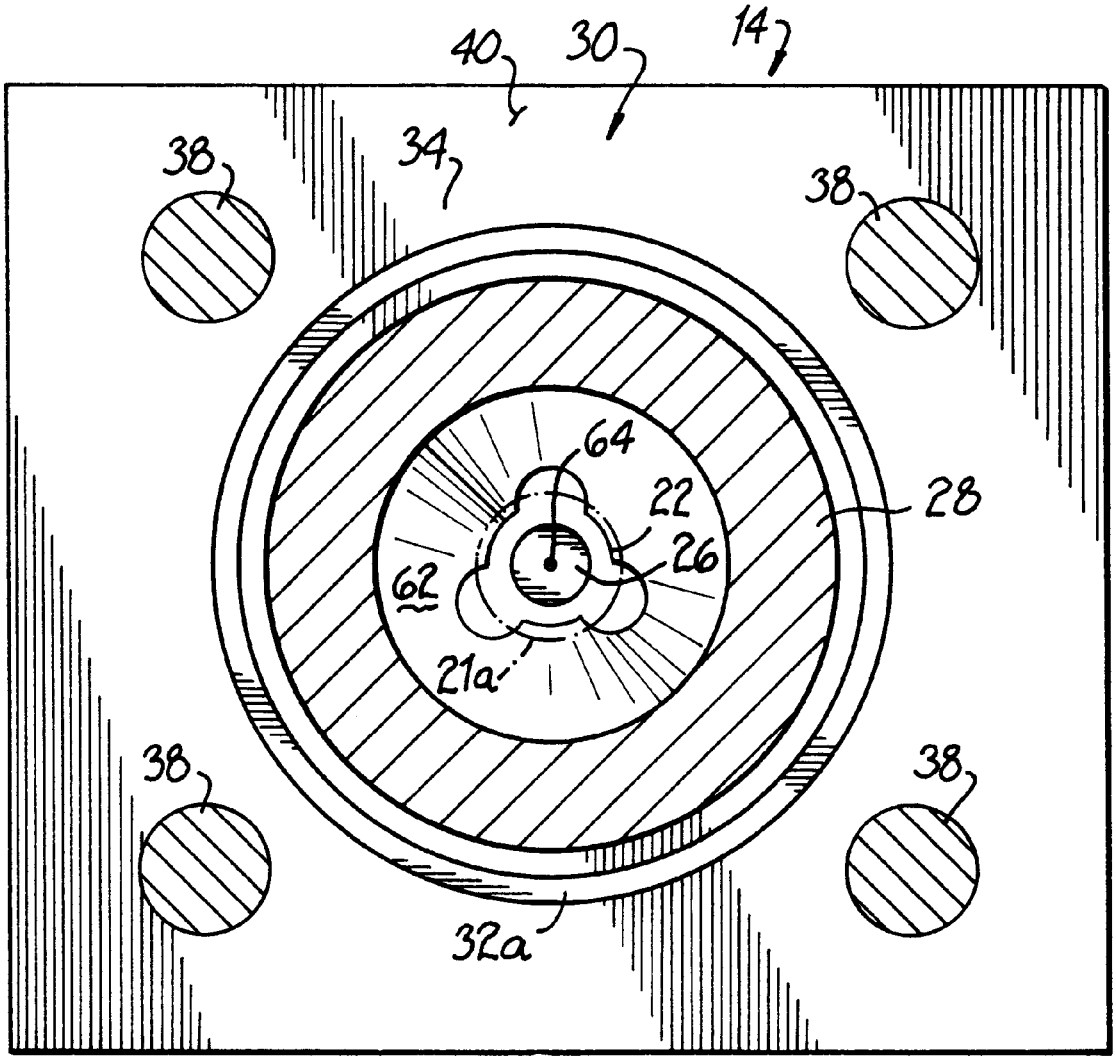
FIG. 3 is an enlarged cross-sectional view of the liquid discharge assembly taken along line 3—3 of FIG. 2.

With reference to FIGS. 1–3, the liquid discharge assembly 14 includes a nozzle 26. The liquid discharge assembly 14 further includes an inner portion 28, an outer portion 30, and a thermally conducting layer 32 positioned between the inner portion 28 and the outer portion 30. The valve seat 22 may be formed on the inner portion 28, as shown, or may be a separate piece. The outer portion 30 has a mounting flange 34 for mounting the liquid discharge assembly 14 to the discharge end 36 of the dispenser body 12. Fasteners 38 connect the mounting flange 34 and, therefore, the outer portion 30 to the discharge end 36. The mounting flange 34 has a mating surface 40 which thermally contacts the discharge end 36 of the dispenser body 12, preferably by direct contact as shown. As such, heat from the dispenser body 12 conducts through mounting flange 34 and thermally conducting layer 32 toward the nozzle 26. Additionally, the outer portion 30 has threads 42 for engaging complimentary internal threads 44 of the nozzle 26.

To facilitate the advantageous transfer of heat from the dispenser body 12 to the nozzle 26, the material of thermally conducting layer 32 has a higher thermal conductivity than the thermal conductivities of the adjacent material making up the inner portion 28 and the outer portion 30. While portions 28, 30 will have a lower thermal conductivity than layer 32, portions 28, 30 are formed of a harder, more wear resistant material than layer 32. A portion 32*a* of the thermally conducting layer 32 forms part of the mating surface 40 and preferably contacts the discharge end 36 of the dispenser body 12. A portion 32*b* of the thermally conducting layer 32, distal from the mating surface 40, may be in direct contact with nozzle 26. Consequently, the heat from dispenser body 12 readily conducts along the thermally conducting layer 32 and is transferred directly through portion 32*b* to the nozzle as well as into the adjacent inner portion 28 and the outer portion 30 which in turn transfers heat to the nozzle 26. Advantageously, the thermally conducting layer 32 is formed from copper and the inner portion 28 and the outer portion 30 are formed from stainless steel. The inner portion 28 also includes a seal 54, such as an O-ring, disposed in channel 56. The seal 54 sealingly engages the discharge end 36 to prevent liquid from leaking along the mating surface 40.

In operation, liquid enters heated dispenser body 12 and flows through liquid passageway 24 of the dispenser body 12. A heat source, such as a heated manifold (not shown), applies heat to the dispenser body 12. When valve stem tip 21*a* retracts away from the valve seat 22, the heated liquid flows through liquid passageway 62 in the inner portion 28. The heated liquid then flows through a discharge passage 64 in the nozzle 26. As the liquid flows through the dispenser 10, the heated dispenser body 12 conducts heat through the discharge end 36 and into the liquid discharge assembly 14 through thermally conducting layer 32. Specifically, the heat can travel directly into interface portion 32*a* of thermally conducting layer 32 by way of its direct contact with the dispenser body 12. Because of the relatively high thermal conductivity of the thermally conducting layer 32, heat flows readily through the thermally conducting layer 32. This helps maintain the temperature of the heated liquid, such as hot melt adhesive, at or very close to the required application temperature.

Figure 4:
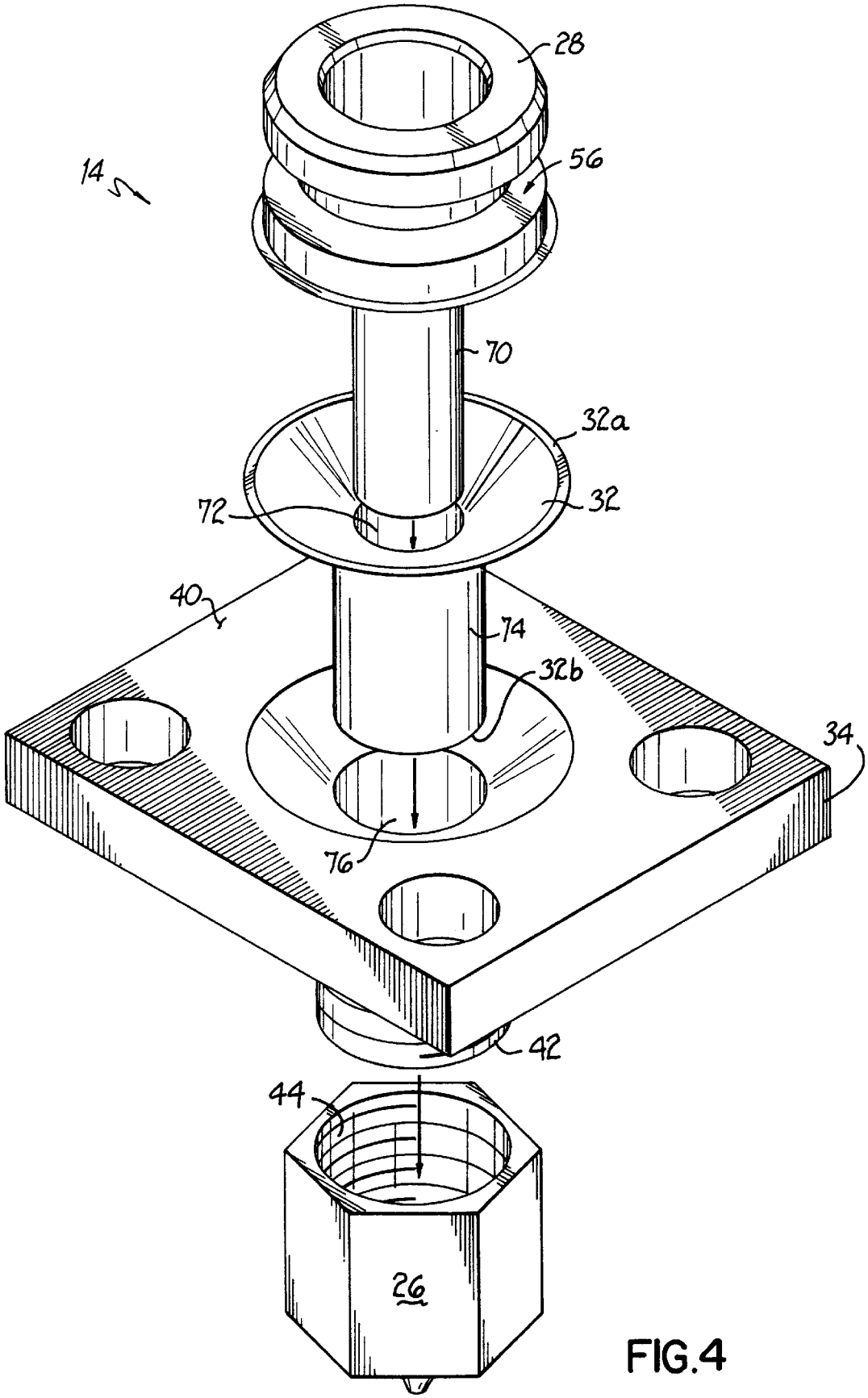
FIG. 4 is a disassembled perspective view of the liquid discharge assembly of FIG. 1.

With reference to FIG. 4, the liquid discharge assembly 14 is assembled from three individually manufactured components, including the inner portion 28, the outer portion 30 and the thermally conducting layer 32. Preferably, the inner portion 28 and the outer portion 30 are manufactured using a metal injection molding (MIM) process. This process allows the valve seat portion 28 and the outer portion 30 to be manufactured efficiently and economically relative to other machining processes, thereby reducing the overall cost of the liquid discharge assembly 14. The thermally conducting layer 32 is preferably manufactured using a deep drawing process from a unitary piece of copper. The liquid discharge assembly 14 is then assembled into a unitary structure by aligning the thermally conducting layer 32 with the outer portion 30 on one side and the inner portion 28 on the other side. Specifically, a cylindrical outer portion 70 of the inner portion 28 is aligned with a bore 72 in the thermally conducting layer 32. Likewise, a cylindrical outer portion 74 of the thermally conducting layer 32 is aligned with a bore 76 in the outer portion 30. After aligning the three pieces, an applied external force press fits the three pieces together as shown in FIG. 2. It should be understood that this specific assembly process and component configuration is only one of many potential variations falling within the scope of this invention. There may be more than three components or layers as well.

While the present invention has been illustrated by a description of various preferred embodiments and while these embodiments have been described in considerable detail in order to describe the best mode of practicing the invention, it is not the intention of Applicant to restrict or in any way limit the scope of the appended claims to such detail. Additional advantages and modifications within the spirit and scope of the invention will readily appear to those skilled in the art. The invention itself should only be defined by the appended claims, wherein I claim:

I claim:

1. A dispenser for discharging heated liquids comprising:

a dispenser body with a liquid passageway adapted to connect to a source of heated liquid; and a liquid discharge assembly connected to the dispenser body and including an inner portion having a liquid passageway in fluid communication with the liquid passageway in the dispenser body, an outer portion, and a thermally conducting layer positioned between the inner portion and the outer portion, the thermally conducting layer thermally contacting the dispenser body and having a thermal conductivity higher than the thermal conductivities of the adjacent inner and outer portions.

2. The dispenser of claim 1 wherein the liquid discharge assembly has a surface mating to the dispenser body and a discharge end for discharging the heated liquid, the thermally conducting layer extending from the mating surface to the discharge end.

3. The dispenser of claim 2, wherein the thermally conducting layer is in direct contact with a nozzle.

4. The dispenser of claim 1 wherein the thermally conducting layer is formed of copper.

5. The dispenser of claim 1 wherein the inner portion and the outer portion are formed of stainless steel.

6. The dispenser of claim 1 wherein one end of the outer portion includes threads for mating with a nozzle.

7. The dispenser of claim 1 further including a nozzle carried by the outer portion.

8. The dispenser of claim 1, wherein the inner portion includes a valve seat and further comprising a valve stem mounted for selectively mating with the valve seat.

9. A liquid discharge assembly adapted to connect to a heated fluid dispenser body with a liquid passageway, the liquid discharge assembly comprising:

an inner portion having a liquid passageway adapted to be in fluid communication with the liquid passageway in the dispenser body;

an outer portion; and a thermally conducting layer positioned between the inner and outer portions, the thermally conducting layer adapted to thermally contact the heated dispenser body and having a thermal conductivity higher than the thermal conductivities of the adjacent inner and outer portions.

10. The liquid discharge assembly of claim 9 further comprising a mating surface for attachment to the dispenser body and a discharge end for discharging the heated liquid, the thermally conducting layer extending from the mating surface to the discharge end.

11. The liquid discharge assembly of claim 10 wherein a discharge end of the thermally conducting layer is adapted for mating with a nozzle.

12. The liquid discharge assembly of claim 9 wherein the thermally conducting layer is formed of copper.

13. The liquid discharge assembly of claim 9 wherein the inner and the outer portions are formed of stainless steel.

14. The liquid discharge assembly of claim 9 wherein the outer portion includes threads for mating with a nozzle.

15. The liquid discharge assembly of claim 9 further comprising means for attaching a nozzle to said outer portion.

16. The liquid discharge assembly of claim 9 further including a nozzle carried by the outer portion.

17. The liquid discharge assembly of claim 9 wherein the inner portion includes a seat for mating with a valve.

18. A method of manufacturing a heat conductive, wear resistant liquid discharge assembly, the method comprising:

forming an inner portion with a liquid discharge passage and comprising a wear resistant metal having a thermal conductivity, forming an intermediate thermally conducting portion from a metal having a higher thermal conductivity than the thermal conductivity of said inner portion, forming an outer nozzle portion from a wear resistant metal, and fixing the inner portion, intermediate thermally conducting portion and outer portion together with the intermediate thermally conducting portion disposed between the inner and outer portions so as to conduct heat to liquid traveling through said liquid discharge passage.

19. The method of claim 18, wherein the step of fixing the inner portion, intermediate thermally conducting portion, and outer portion together further comprises press fitting each portion to an adjacent portion.

20. The method of claim 18 further comprising forming said inner portion with an integral valve seat.

21. The method of claim 18, wherein the steps of forming said inner and outer portions further comprise molding said inner and outer portions.

* * * * *